US005169030A

United States Patent [19]

Lewin

[11] Patent Number: 5,169,030

[45] Date of Patent: Dec. 8, 1992

[54] DISPENSER TUBE WITH INTERNAL SECTIONS

[76] Inventor: Jack R. Lewin, 266 Edgewood Ave., Mill Valley, Calif. 94941

[21] Appl. No.: 857,984

[22] Filed: Mar. 26, 1992

[51] Int. Cl.[5] ..... B65D 35/00

[52] U.S. Cl. ..... 222/92; 222/107; 222/490

[58] Field of Search ..... 222/92, 94, 107, 490, 222/491, 494, 108, 571

[56] References Cited

U.S. PATENT DOCUMENTS

| | | | |
|---|---|---|---|
| 1,122,868 | 12/1914 | Davis | 222/490 |
| 1,206,661 | 11/1916 | Booth | 222/490 |
| 1,859,397 | 5/1932 | Johnson et al. | 222/490 |
| 3,081,006 | 3/1963 | Land | 222/491 X |
| 5,105,985 | 4/1992 | Kroeber | 222/107 |

FOREIGN PATENT DOCUMENTS

| | | | |
|---|---|---|---|
| 1519814 | 4/1968 | France | 222/92 |
| 219824 | 2/1942 | Switzerland | 222/92 |

*Primary Examiner*—Kevin P. Shaver

*Attorney, Agent, or Firm*—Larry D. Johnson

[57] ABSTRACT

A dispenser tube provides a flexible envelope portion having an open end selectively sealed with a removable cap, and a sealed base, and includes at least one flexible diaphragm member bearing at least one one-way valve positioned in the tube internal cavity and defining a pair of cavity sections. As the tube is squeezed, the fluid material in the tube is sequentially displaced from one cavity section into the next in the direction of the open end, and is prevented from flow back towards the sealed end by the one-way valve.

1 Claim, 2 Drawing Sheets

DISPENSER TUBE WITH INTERNAL SECTIONS

BACKGROUND OF THE INVENTION

1. Field of the Invention

This invention relates generally to tubes and other containers, and more specifically to an improved dispenser tube device for fluid materials.

2. Description of the Prior Art

Dispenser tubes for fluid materials are well known. Most such tubes provide a flexible housing or envelope member with a unitary internal cavity generally filled with the material to be dispensed (e.g., toothpaste), and having one open end selectively sealable with a cap or other structure, and a permanently sealed base. When the cap is removed, the user may squeeze the tube housing, and a (desired) quantity of material is dispensed through the opening. However, pressing or squeezing the tube at any point other than the extreme base often results in some portion of the material being displaced forward, and the remainder being displaced backward in the cavity towards the base. This effect becomes even more pronounced as the tube becomes less full. The problem can be somewhat alleviated by "rolling" the tube up from the base as the contents are dispensed, thereby reducing the size of the remaining cavity and forcing the material to exit through the opening, but even this procedure can be awkward and inefficient.

A further problematic issue with a dispenser tube having a unitary internal cavity is that some materials can become hard or otherwise unusable after the tube has been opened and its contents exposed to air. For example, glue or other volatile materials may harden in their dispenser tube after only a few uses.

SUMMARY OF THE INVENTION

The dispenser tube of this invention provides a container device comprising a flexible housing or envelope portion having an open end selectively sealed with a removable cap or other structure, and a sealed base, and including at least one flexible diaphragm member bearing at least one one-way valve positioned in the tube internal cavity and defining a pair of cavity sections. In the preferred embodiment, several diaphragm members are disposed within the tube internal cavity and sealed to the cavity inside wall, thereby defining a series of cavity sections. As the tube is squeezed, the fluid material in the tube is sequentially displaced from one cavity section into the next in the direction of the open end, and the material is prevented from flow back towards the sealed end by the one-way valves.

BRIEF DESCRIPTION OF THE DRAWINGS

FIG. **6*a* is a side elevation cross-sectional view of a portion of the flexible diaphragm member of FIG. 6, this view taken along line 6*a*—6*a* of FIG. 6.

DETAILED DESCRIPTION OF A PREFERRED EMBODIMENT

Figure 1:
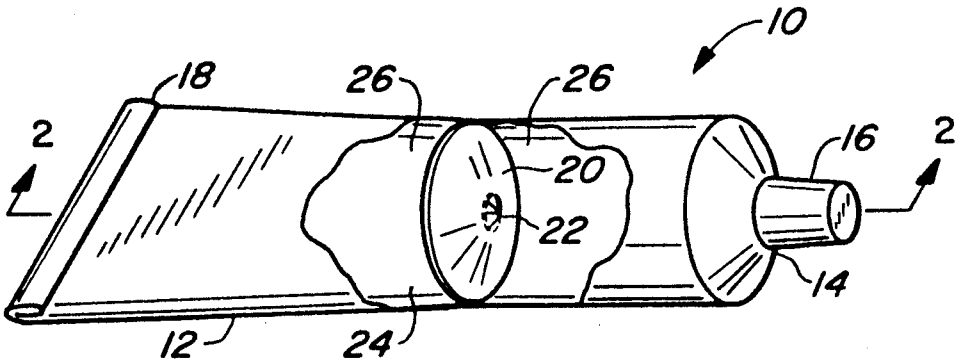
FIG. 1 is a partially cutaway perspective view of a dispenser tube of this invention illustrating a flexible housing or envelope portion having an openable end selectively sealed with a removable cap, and a sealed base, with a flexible diaphragm member bearing a one-way valve positioned in the tube internal cavity and defining pair of cavity sections.

FIG. 1 is a partially cutaway perspective view of a dispenser tube 10 of this invention illustrating a flexible housing or envelope portion 12 having an openable end 14 selectively sealed with a removable cap 16, and a sealed base 18, with a flexible diaphragm member 20 bearing a one-way valve 22 positioned in the tube internal cavity 24 and defining a pair of cavity sections 26. Contents of the tube can thus flow from more basal cavity sections towards more ventral cavity sections, but not the other way. Sealed base 18 is crimped or otherwise permanently sealed.

Figure 2:
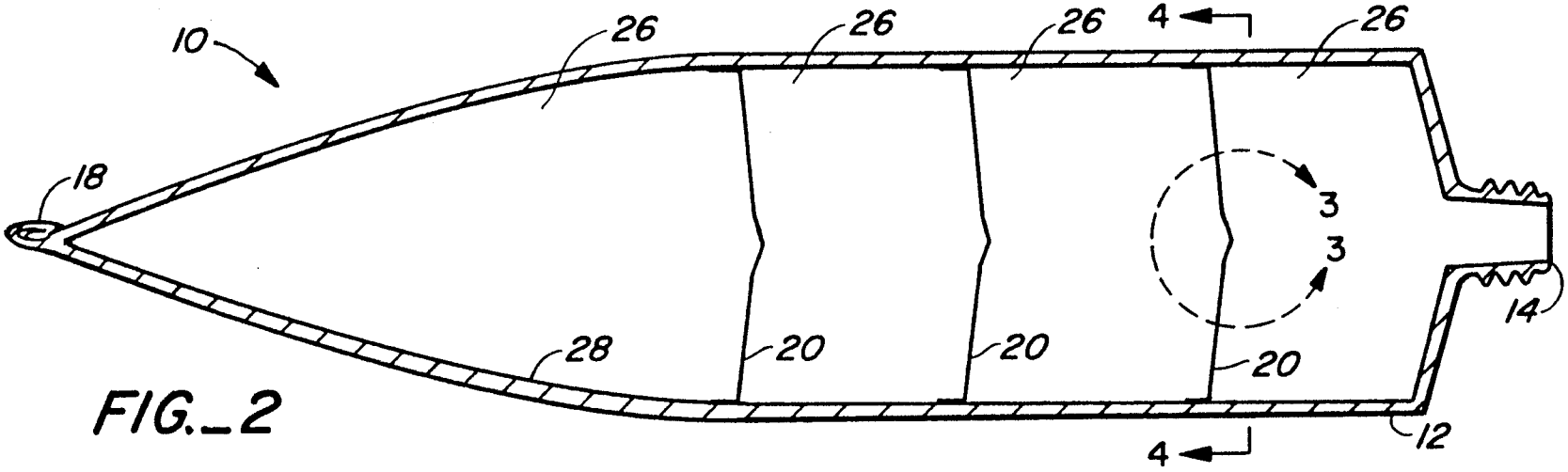
FIG. 2 is an enlarged side elevation cross-sectional view of the dispenser tube of FIG. 1, illustrating the flexible envelope having an openable end and a sealed base, with a series of flexible diaphragm members disposed within the tube internal cavity and sealed to the cavity inside wall, thereby defining a series of cavity sections, this view taken along line 2—2 of FIG. 1.

FIG. 2 is an enlarged side elevation cross-sectional view of the dispenser tube 10 of FIG. 1, illustrating the flexible envelope 12 having an openable end 14 and a sealed base 18, with a series of flexible diaphragm members 20 disposed within the tube internal cavity 24 and sealed to the cavity inside wall 28, thereby defining a series of cavity sections 26, this view taken along line 2—2 of FIG. 1. Depending on the materials used, sealing of the diaphragms to the cavity inside wall 28 can be accomplished by gluing, thermal welding, or other suitable techniques.

Figure 3:
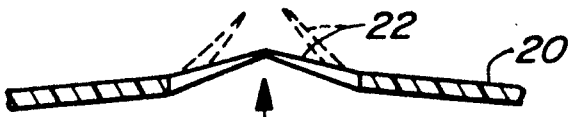
FIG. 3 is a side elevation cross-sectional view of a portion of one flexible diaphragm member and integral one-way valve, this view taken along line 3—3 of FIG. 2.
Figure 6A:
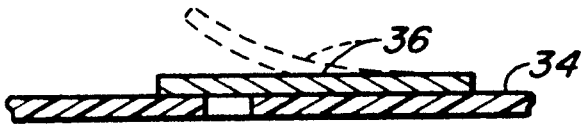
FIG. 6 is an end elevation view of a flexible diaphragm member bearing a plurality of an alternative type of integral one way valves.
Figure 4:
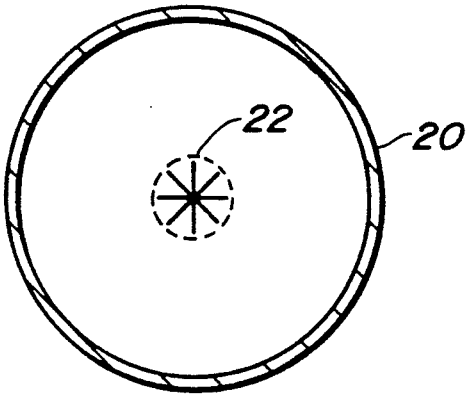
FIG. 4 is an end elevation view of one flexible diaphragm member and integral one-way valve, this view taken along line 4—4 of FIG. 2.

FIG. 3 is a side elevation cross-sectional view of a portion of one flexible diaphragm member 20 and integral one-way valve 22, this view taken along line 3—3 of FIG. 2, while FIG. 4 is an end elevation view of one flexible diaphragm member 20 and integral one-way valve 22, this view taken along line 4—4 of FIG. 2. These views illustrate the simplest arrangement of a single one-way valve positioned generally in the center of the diaphragm, and would be suitable for many applications.

Figure 5:
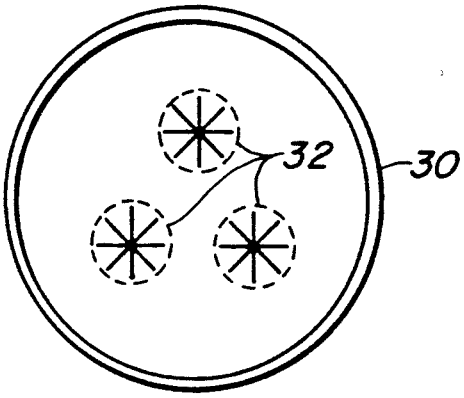
FIG. 5 is an end elevation view of a flexible diaphragm member bearing a plurality of integral one-way valves.

FIG. 5 is an end elevation view of a flexible diaphragm member 30 bearing a plurality of integral one-way valves 32. The size, quantity, and positioning of the valves in the diaphragm is preferably a function of the diameter of the diaphragm (i.e., the tube envelope), the viscosity of the material to be dispensed, and other factors.

Figure 6:
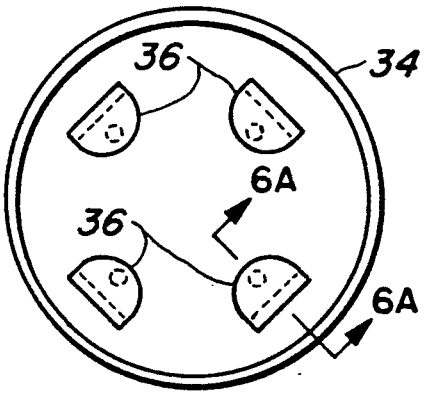

FIG. 6 is an end elevation view of a flexible diaphragm member 34 bearing a plurality of an alternative flap-type integral one-way valves 36, while FIG. **6*a* is a side elevation cross-sectional view of a portion of the flexible diaphragm member 34 of FIG. 6, this view taken along line 6a—6a of FIG. 6**. These flap-type valves may be preferable for certain material applications.

Figure 7:
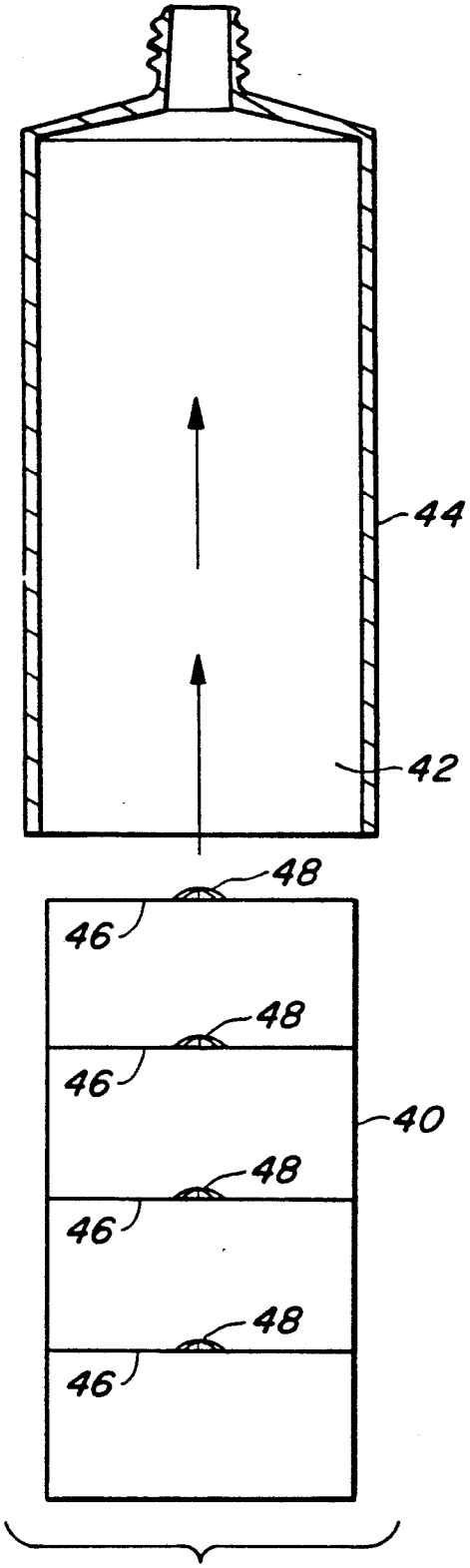
FIG. 7** is a side elevation cross-sectional view of an alternate embodiment of the dispenser tube of this invention, illustrating a discrete inner dispenser tube portion being inserted into an otherwise standard dispenser tube.

FIG. 7 is a side elevation cross-sectional view of an alternate embodiment of the dispenser tube of this invention, illustrating discrete inner dispenser tube portion 40 being inserted into the cavity 42 of an otherwise standard dispenser tube 44. Inner tube 40 itself bears a plurality of diaphragm members 46 each bearing one or more one-way valves 48. This "modular" arrangement would enable a quantity of material to be dispensed to be packaged in an inner tube, and subsequently inserted into a pre-existing standard tube.

While this invention has been described in connection with preferred embodiments thereof, it is obvious that modifications and changes therein may be made by those skilled in the art to which it pertains without departing from the spirit and scope of the invention. For example, the tube envelope could be made of transparent material so that the material contents could be inspected and viewed. Accordingly, the scope of this invention is to be limited only by the appended claims.

What is claimed as invention is:

1. A dispenser tube for dispensing a quantity of fluid material, said dispenser tube comprising:

a flexible envelope portion having an open end selectively sealed with a removable cap, a sealed base, and an internal cavity having an inside wall; and a plurality of flexible diaphragm members each bearing at least one one-way valve positioned in said tube internal cavity and sealed to said cavity inside wall, said diaphragm members defining a series of cavity sections, said at least one one-way valve of each diaphrage member permitting flow only in the direction of said open end.

* * * * *